United States Patent [19]

Harvey

[11] 4,123,956

[45] Nov. 7, 1978

[54] SELF-ADJUSTING PUNCH DEVICE

[75] Inventor: David L. Harvey, Schoolcraft, Mich.

[73] Assignee: Arco Industries Corporation, Schoolcraft, Mich.

[21] Appl. No.: 832,136

[22] Filed: Sep. 12, 1977

[51] Int. Cl.[2] ..... B26F 1/14

[52] U.S. Cl. ..... 83/620; 83/685; 83/687

[58] Field of Search ..... 83/685, 687, 691, 695, 83/620

[56] References Cited

U.S. PATENT DOCUMENTS

| | | | |
|---|---|---|---|
| 3,096,015 | 7/1963 | Bradbury | 83/685 UX |
| 3,299,761 | 1/1967 | Goldman | 83/685 X |
| 3,463,042 | 8/1969 | Goldman | 83/685 X |

*Primary Examiner*—Willie G. Abercrombie

*Attorney, Agent, or Firm*—Reising, Ethington, Barnard, Perry & Brooks

[57] ABSTRACT

The present invention relates to a self-centering device for blanking out or punching holes through relatively thin gauge materials and particularly elastomeric materials such as rubber or plastic.

4 Claims, 9 Drawing Figures

SELF-ADJUSTING PUNCH DEVICE

The present invention relates to a device for blanking out or punching holes through relatively thin gauge materials and particularly elastomeric materials such as rubber or plastic. More specifically, the invention relates to a device for punching out such holes cleanly, i.e., without leaving traces of material around the punched hole which must otherwise be trimmed or removed by hand. The unique punch device of the present invention also enables an elastomeric material to be restrained in such a way during the shearing or blanking operation as to prevent distortion of the elastomeric body and thereby assuring the accurate location of such blanked out holes.

The punch device of the present invention includes a uniquely floating or self-adjusting punch element which greatly lessens the possibility of misalignment between the punch and coacting die element so as to prevent damage and reduce wear between such elements and also facilitates the accurate cutting and location of a plurality of holes particularly in thin wall elastomeric materials.

BACKGROUND

Previous devices for punching holes through thin gauge materials, including elastomers, have typically included cylindrical or straight sided punch elements which coact with similarly shaped female die elements to punch out holes in such materials. Various problems arise with the use of straight sided punches which have relatively deep penetration within a coacting die and particularly when blanking out thin gauge elastomeric materials. First, where a straight sided punch penetrates a corresponding straight sided die opening to shear or blank out an intermediate material, a certain clearance must be provided between the punch and die elements. Such clearance is provided to prevent damage and wear as would occur through direct contact between the punch and die. As such clearance increases due either to manufacturing tolerances or wear, there is an increasing tendency of the material being blanked or sheared to be drawn within the clearance space between the punch and die elements. As this occurs, the shearing action becomes less sharp or defined and the material tends to be torn rather than sheared, leaving a somewhat ragged or imprecise hole or edge. As this situation becomes aggravated it is often necessary to manually repair the torn edge or else to reject the part.

The aforementioned problem is accentuated as thinner gauge materials are blanked since the material thickness or gauge begins to approach the clearance between the punch and die. The problem is further aggravated where thin wall elastomeric materials are to be blanked since such materials are stretched through engagement by the punch which further thins the material cross section thereby contributing to tearing and irregularly formed holes. The amount of such stretching will vary directly with the amount of clearance between the punch and die elements. In other words, the greater the amount of clearance between the male and female elements, the greater the amount of stretching. The stretching can cause the elastomeric material to rip or tear rather than being cleanly sheared off with the resultant hole being irregular or having small amounts of material remaining therearound which subsequently have to be removed by hand. Further, such stretching can cause a mislocation of the hole when the elastomeric material contracts after the shearing operation. Such mislocation of holes can be particularly acute in those cases where a plurality of adjacently related holes are being punched through the elastomeric material at the same time. In other words, where multiple punch elements are being utilized and where one or more of such punches, due to the aforementioned clearances between punch and die elements, causes the elastomeric material to be stretched or drawn into a particular die element, then, through such stretching, adjacent sections of the elastomeric material can be laterally displaced thereby causing adjacent holes to be mislocated when the elastomeric material contracts after the punching operation.

Prior experience with the aforementioned straight sided type of cylindrical male and female punch and die elements has shown a relatively high rate of malformed parts requiring either manual correction or total rejection of unusable parts. It has also been found that such rejection or repair rate increases as the punch elements become worn with use. Incidentally, the wear rate for such punches is found to be quite high in shearing such thin sectioned elastomeric materials due to such material being drawn between the die and punch elements.

SUBJECT INVENTION

The unique arrangement of the subject invention avoids stretching or tearing of the elastomeric material so as to result in cleanly sheared or cut holes accurately located in the elastomeric body. Such results are achieved with the subject invention by substantially eliminating the problem of tolerances between the punch and die elements and also by utilizing a punch element which clamps or restrains the elastomeric material around the area to be blanked out or sheared, thereby preventing lateral stretching or displacement of the elastomeric body area surrounding the punched holes.

To achieve these improved results, the subject invention utilizes one or more floating or adjustable ball-shaped punch elements which coact with cylindrical female die elements to shear or blank out holes in an elastomeric body. More specifically, the ball-shaped punch element is oversized, i.e. of a larger diameter than that of the coacting cylindrical female die element. In this way, there is only limited penetration of the ball punch element within the female die element, thereby greatly reducing any tendency of the elastomeric material to stretch during the shearing operation. Shearing of the elastomeric material occurs when the ball element comes into contact with the periphery of the opening of such die element.

The ball-shaped punch element is loosely supported in such a way as to properly locate when brought into mating contact with the female die element. Further, by being loosely supported, the punch element tends to rotate between punching operations thereby distributing wear over the ball surface and greatly increasing the life of the punch. To reduce the shearing shock between the ball punch and die element as they coact to shear the elastomeric material, the present invention utilizes a resilient back-up member against which the ball punch abuts during the shearing operation. The ball punch and resilient back-up member are in engagement only during the shearing operation, thus allowing the ball to be self-adjusting and rotatable after the shearing operation is completed.

While the invention may be utilized with a single ball punch and coacting cylindrical die element, it is hereinafter illustrated and described in a modification utilizing a plurality of such ball punch elements and coacting die elements. Furthermore, the basic machine with which the subject invention is used may be adapted to punching one or a plurality of holes in an elastomeric material simply by changing the punch and die sets to those utilizing single or multiple balls and coacting dies.

As will hereinafter be shown and described in detail, the present invention includes a die element supported upon a fixed platen or base and a ball punch device mounted upon a movable platen. The die element includes a plurality of cylindrical and open-ended holes arrayed thereabout in a pattern reflecting the number and orientation of the various holes to be punched in the elastomeric body. The punch device includes a support ring or cage adapted to retain a plurality of ball punch elements corresponding in number and orientation to the die holes in such a way that the balls are sufficiently loose to permit limited lateral adjustment as well as rotation relative to the die holes. It is an important aspect of the present invention that the diameter of each ball punch is substantially larger than the diameter of the corresponding die hole. Thus, such diametral relationship insures that there is only limited penetration by the ball punch within its coacting die hole. The shearing action of the elastomeric material occurs as the ball punch contacts the upper periphery of the die hole.

Since the ball punch is larger than its coacting die hole, the elastomeric material is pinched and sheared at the upper periphery of the die opening thereby greatly reducing any tendency of the material to be stretched and insuring a sharply cut hole in the material. In thus shearing the elastomeric material, the ball punch and the cylindrical die element are in abutting and non-sliding contact.

To absorb the shock or load of the abutting shearing action between the punch and die elements and also to reduce the wear between the latter elements, a resilient or energy absorbing back-up member is disposed between the ball members and the movable support structure upon which the ball punch device is mounted. Typically, such back-up member can be a block of nylon generally corresponding in diameter to the size of the ball support ring. The ball punch elements are adapted to abut against the back-up member only during the punching or shearing operation and are otherwise free to laterally adjust and rotate both with respect to the back-up member and the ball support ring. Since the ball punch and die elements are made of steel, the nylon back-up member will be deflected or temporarily depressed by the ball punch to dissipate the shock load occasioned by the engagement between the punch and die elements.

While illustrated and described as blanking out holes in thin wall elastomeric materials such as rubber or plastics, the subject invention may also be utilized with other shearable thin wall materials.

Figure 1:
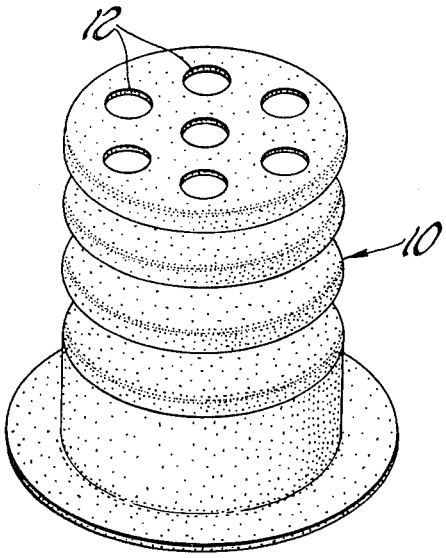
FIG. 1 illustrates a product having holes blanked out by the subject apparatus.

FIG. 1 depicts an elastomeric boot member 10 having holes 12 blanked from one end thereof by the apparatus of the subject invention. In this case, boot 10 is made of a rubber material having a wall thickness of approximately 0.020 inch. In use, electrical wires are passed through and maintained in spaced relationship by holes 12.

Figure 2:
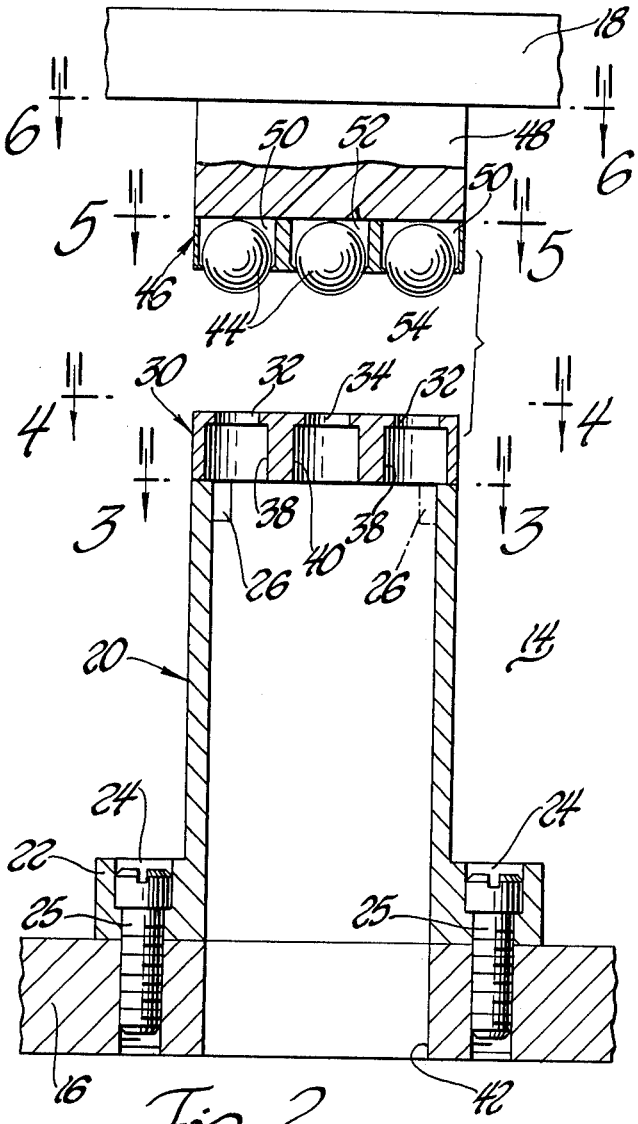
FIG. 2 is a partially sectioned elevational view of the invention assembled within a press.
Figure 3:
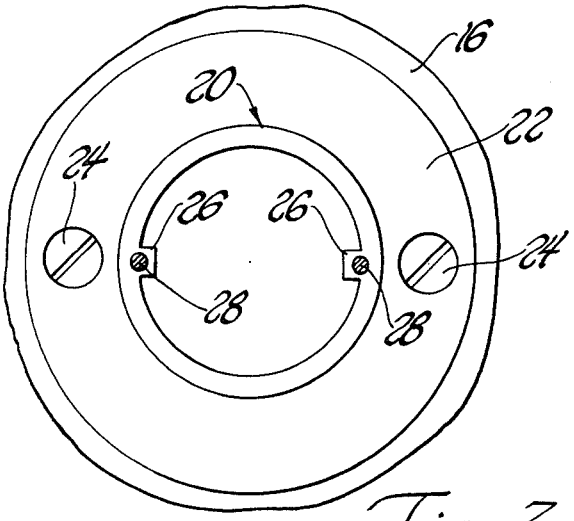
FIG. 3 is a view of the die support element taken along line 3—3 of FIG. 1.

Referring now to FIG. 2, a press is indicated generally at 14 and includes a fixed base portion 16 and a movable upper platen 18. While not shown, press 14 includes suitable hydraulic means for actuating platen 18 toward and away from base portion 16. A hollow support member 20 includes a lower circular flange portion 22 having suitable holes 24 formed therein for mounting the support upon press base 16 through screw members 25. A pair of diametrically aligned projections 26 are formed internally of support member 20 at its upper end and include a pair of threaded holes adapted to receive die retaining screws 28.

Figure 4:
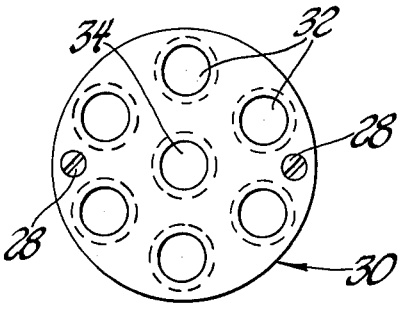
FIG. 4 is a view of the die element taken along line 4—4 of FIG. 1.

A die member 30 is mounted on the upper end of support member 20. Referring also to FIG. 4 of the drawings, a plurality of holes 32 are circularly arrayed about die element 30. The die element also includes a central hole 34. It is to be understood that the number of holes and their arrangement is determined by the number of holes to be punched from the elastomeric member such as the boot 10 shown in FIG. 1. In the modification shown in FIGS. 2 and 4, holes 32 are circularly spaced at 60° angles from each other.

A pair of diametrically opposed holes are formed in die element 30 and are adapted to be aligned with the corresponding holes in support member projections 26 and through which holes suitable screw elements 28 secure die element 30 to support element 20.

As best seen in FIG. 2, die holes 32 and 34 also include suitable counterbored sections 38 and 40, the purpose of which is to allow the blanked out portions of the elastomeric material to fall freely through the die and support member where they may empty out of a hole 42 formed in press base member 16.

In the illustrated embodiment, die element 30 is formed of a carbon steel having a Rockwell C hardness of about 58. Holes 32 have a diameter of 0.370 inch while the diameter of hole counterbores are 0.375 inch. In the configuration to be punched, central hole 34 is slightly smaller than the circularly arrayed holes 32 and has a diameter of 0.320 inch and a correspondingly enlarged counterbored section 40 of 0.325 inch. Thus, support 20 and die element 30 form the fixed or stationary die portion of press apparatus 14.

The punch portion of press apparatus 14 includes movable platen 18, a plurality of ball elements 44, a ball supporting cage 46 and a resilient ball back-up member 48 arranged as indicated in FIG. 2.

Figure 5:
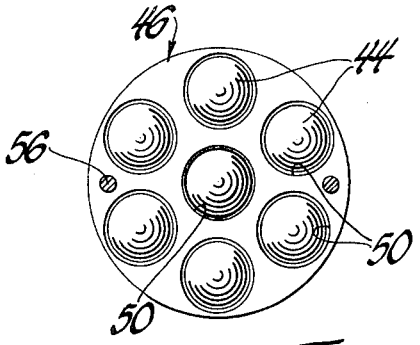
FIG. 5 is a view of the ball ring or cage taken along line 5—5 of FIG. 1.
Figure 6:
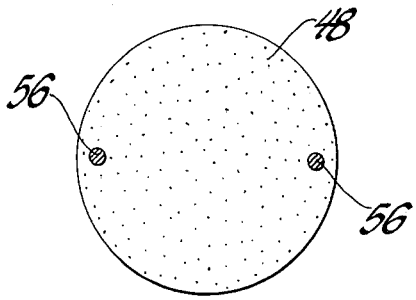
FIG. 6 is a view of the resilient back-up member taken along line 6—6 of FIG. 1.

As best seen by comparing the views of FIGS. 4 and 5, the configuration of ball cage 46 is essentially identical to that of die element 30. Referring particularly to FIGS. 2 and 5, it is to be noted that ball cage element 46 again includes a plurality of holes 50 circularly arrayed thereabout at 60° angles from each other as well as a central hole 52. For reasons which will subsequently be discussed, balls 44 are larger than holes 32–34 formed in die element 30. It is also to be noted that cage holes 50–52 are slightly larger than balls 44 so as to provide a clearance therebetween. Accordingly, the circularly arrayed holes 50 and hole 52 in ball cage 46 are also larger than the holes 32 in die element 30. More specifically, ball cage holes 50 and 52 have diameters of approximately 0.520 inch. Ball cage holes 50 and 52 are cylindrical in cross-section except that the lower end thereof is turned inwardly so as to provide an annular flange 54 which retains balls 44 within cage 46. The in-turned annular flanges 54 formed at the bottom of holes 50–52 have a diameter of 0.480 inch while the diameter of balls 44 is 0.520 inch. Thus, it will be seen that while balls 44 are loosely disposed within cage holes 50–52, the annular flange 54 formed at the bottom of such holes prevents the balls from dropping out of the cage.

As seen in FIG. 5, ball cage 46 also includes a pair of diametrically opposite holes through which suitable screw means 56 extend to mount the cage to platen 18.

Resilient ball back-up member 48 is disposed intermediate ball cage 46 and movable platen 18 and has a circular configuration and diametral size corresponding to that of ball cage element 46. Back-up member 48 also includes a pair of diametrically opposite holes which are adapted to be aligned with corresponding holes in ball cage element 46 and through which suitable screw elements 56 are inserted and threaded into movable platen 18 to retain the cage and back-up members thereto. Except for its mounting holes, back-up element 48 is preferably of a solid cross-section. The function of back-up element 48 is to absorb and dissipate the impact shock imposed on ball members 44 and die element 30 during the blanking or cutting operation. Accordingly, back-up element 48, while being firm and not permanently deformable, must have a resilient character. It is found that a material, such as nylon, having an 80–85 durometer is most satisfactory for this application.

Figure 8:
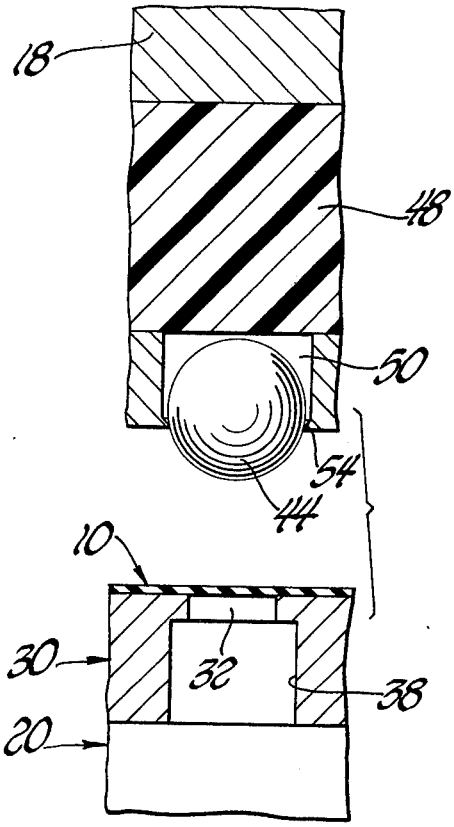
FIGS. 8 and 9 are enlarged sectional views showing the relationship between the ball punch, the shearable material, and the die element prior to and during the blanking operation.
Figure 9:
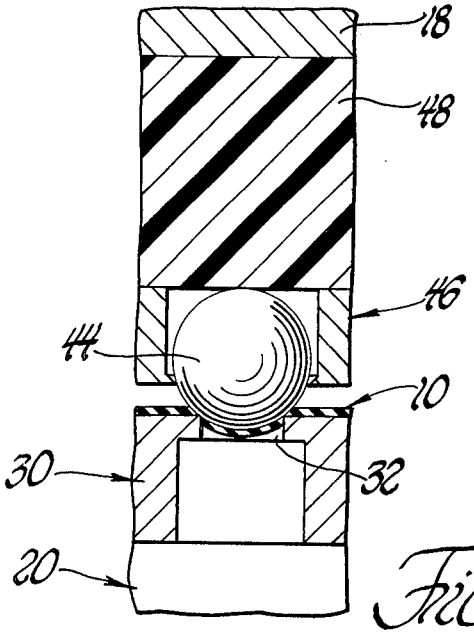

In order to clearly understand the manner in which the subject apparatus functions, reference is now made to the enlarged sectional views of FIGS. 8 and 9. To simplify the explanation, FIGS. 8 and 9 are limited to showing one ball 44 and its coacting hole 32 in the die element 30. In the view of FIG. 8, platen 18 is raised whereby ball 44 is vertically spaced above die element 30. As seen in this view, ball 44 hangs free of or below back-up member 48 and is also laterally clear of the side walls of hole 50 of ball cage 46. In this condition, ball 44 lightly rests on the annular hole flange 54 which prevents the ball from dropping out of the cage hole. Thus, when the platen is raised, ball 44 is substantially free-floating and projects below the lower surface of ball cage 46.

When the platen is in the raised condition of FIG. 8, boot 10, prior to being punched, is placed over and is supported upon support member 20 and die element 30 such that the thin wall material overlies die hole 32.

In FIG. 9, platen 18 has been moved downwardly as part of the punching or blanking operation. In this position, ball 44 engages elastomeric material around the periphery of die hole 32 and, in turn, causes the material to be sheared between the ball and the hole edge. As it engages die hole 32, ball 44 is moved upwardly into abutting engagement with back-up element 48 which in turn absorbs and dissipates the shock of impact between the ball and the die element and, at the same time, provides sufficient support to the ball to complete the shearing action of the material of boot 10. Thus, while there is metal-to-metal contact between ball 44 and die element 30 such as to cleanly shear the boot material, the shock of this contact is cushioned by resilient back-up element 48.

As opposed to straight sided or cylindrical dies and punches wherein clearance between the die and punch is crucial both as to the quality of the shear and the wear between the components, the present apparatus is such that the ball punch is substantially larger than the die hole and only makes limited penetration thereof to ensure a positive and sharp cutting interaction between the ball and die hole and which relationship obviates the problems which arise due to clearances between straight sided or cylindrical punch which relatively deeply penetrate a coacting die element.

It is again to be noted in the subject apparatus and as particularly shown in FIG. 9, there is very limited penetration cf ball member 44 within die hole 32 prior to the elastomeric material being pinched or retained between the ball and the hole periphery. The advantage of this relationship is to greatly reduce the tendency of the elastomeric boot material surrounding the die hole to be stretched as the material is depressed within the die opening. This reduced stretching of the elastomeric material during the shearing operation assures the accurate location of the blanked-out holes and particularly in relation to adjacently blanked holes.

Figure 7:
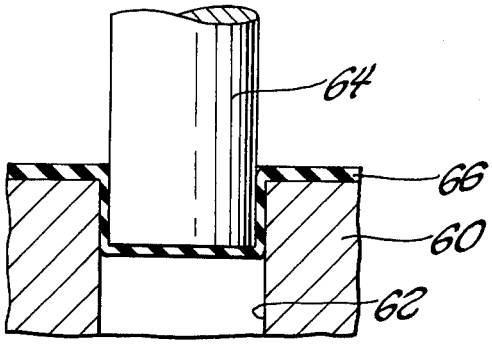
PRIOR ART Fig. 7
FIG. 7 is a view of a prior art type straight sided punch and coacting die.

By contrast, straight sided or cylindrical punch inherently give rise to problems as the clearance between such a punch and its coacting die element is enlarged either through wear or manufacturing tolerances. Due to such clearances, there is a great tendency of a thin wall and particularly an elastomeric material to be stretched or elongated within the die element during the shearing operation. This latter phenomenon is illustrated in FIG. 7 of the drawings wherein a die element is indicated at 60 and includes a hole 62 and within which a straight sided punch element 64 is adapted to project to shear an elastomeric material 66. In order to prevent damage and/or wear between punch 64 and die 60, a suitable clearance must be provided between the punch and die. Inevitably, the thin wall elastomeric material 66, to some degree, is drawn or stretched into the clearance between the die 60 and the punch 64 until it is sheared or otherwise tears. As the clearance between punch and die is increased, either due to manufacturing tolerances or wear, the holes punched in the elastomeric material become less sharp due to tearing rather than shearing and frequently leave portions of the material which must be trimmed by hand. Further, as such clearance increases, the tendency is to stretch the elastomeric material into the hole and thereby cause misalignment or mispositioning of the holes with respect to adjacent holes.

By having a limited penetration of the ball member 44 within die hole 32 and a positive engagement between the ball and die shearing surfaces, the clearance problem of prior art devices is avoided.

It is apparent that various modifications may be made in the subject invention as comprehended by the hereinafter appended claims.

What is claimed is:

1. A device for blanking out holes in a shearable material, said device including a fixed die element having hole means formed therein; a movable member aligned with said die element; and punch means mounted upon said movable member, said punch means including a retaining element, ball means loosely retained in and adapted to project from said retaining element, said ball means being aligned with and having a diameter greater than the hole means in the die element, and an elastomeric backing member mounted between said retaining element and the movable member and adapted to be engaged by said ball means, said movable member being adapted to position said ball means in peripheral contact with the aligned hole means in said die element whereby said ball means projects partially within said hole means, said peripheral contact moving said ball means into abutting relationship with said backing member causing material retained between the coacting surfaces of said ball means and said die hole means to be sheared off.

2. A device for blanking out holes in a shearable material as set forth in claim 1 wherein said retaining element includes cylindrical ball-retaining hole means formed therethrough and which terminate at one end adjacent the backing member, the diameter of said cylindrical ball-retaining hole means being larger than the diameter of said ball means whereby the latter is laterally adjustable within said retaining element.

3. A device for blanking out holes in a shearable material, said device including a fixed die element having a pair of planar and parallel spaced surfaces, hole means formed through said die element and terminating at said planar surfaces; a movable member aligned with said die element and having a surface parallel to the planar surfaces of said die element; and punch means mounted upon the planar surface of said movable member, said punch means including a retaining element having a pair of planar and parallel spaced surfaces, ball means loosely retained in and adapted to project from the planar surface of said retaining element proximately spaced from said die element, said ball means being aligned with and having a diameter greater than the hole means in the die element, and an elastomeric backing member abuttingly mounted between one planar surface of said retaining element and the planar surface of said movable member and adapted to be engaged by said ball means, said movable member being adapted to position said ball means in peripheral contact with the aligned hole means in said die element whereby said ball means projects partially within said hole means, said peripheral contact moving said ball means into abutting relationship with said backing member causing material retained between the coacting surfaces of said ball means and said die hole means to be sheared off.

4. A device for blanking out holes in a shearable material as set forth in claim 3 wherein the ball retaining element includes cylindrical hole means formed therethrough and terminating in its spaced planar surfaces, the retainer hole means being of larger diameter than said ball means, the distance between the planar surfaces of said retaining element being less than the diameter of said ball means whereby the ball means projects beyond the planar surface of the retaining element opposite from said resilient backing member.

* * * * *